US005748218A

United States Patent [19]

Stelter et al.

[11] Patent Number: 5,748,218

[45] Date of Patent: May 5, 1998

[54] METHOD FOR FORMING TONER IMAGES WITH TWO DISTINCT TONERS

[75] Inventors: Eric C. Stelter, Pittsford; Joseph E. Guth, Holley; W. Charles Kasiske, Penfield, all of N.Y.

[73] Assignee: Eastman Kodak Company, Rochester, N.Y.

[21] Appl. No.: 583,732

[22] Filed: Jan. 17, 1996

[51] Int. Cl.[6] ..... G03G 15/00; B41J 2/385

[52] U.S. Cl. ..... 347/158; 399/232

[58] Field of Search ..... 347/158, 153, 347/115; 399/232, 156, 127, 159, 231

[56] References Cited

U.S. PATENT DOCUMENTS

| | | | |
|---|---|---|---|
| 4,546,060 | 10/1985 | Miskinis et al. | 430/108 |
| 5,001,028 | 3/1991 | Mosehauer et al. | 430/45 |
| 5,045,893 | 9/1991 | Tabb . | |
| 5,049,949 | 9/1991 | Parker et al. . | |
| 5,053,821 | 10/1991 | Kunugi et al. | 399/134 |
| 5,208,636 | 5/1993 | Rees et al. . | |
| 5,241,356 | 8/1993 | Bray et al. . | |
| 5,258,820 | 11/1993 | Tabb . | |
| 5,409,791 | 4/1995 | Kaukeinen et al. | 430/54 |
| 5,485,190 | 1/1996 | Koetter et al. | 347/130 |

FOREIGN PATENT DOCUMENTS 0 625 730 11/1994 European Pat. Off. ..... G03G 15/01

*Primary Examiner*—Peter S. Wong
*Assistant Examiner*—Gregory J. Toatley, Jr.
*Attorney, Agent, or Firm*—Norman Rushefsky

[57] ABSTRACT

An image forming method which forms a two color toner image or an image made up of two types of toners of the same color includes forming a first image with discharged area development (DAD) and a second image with charged area development (CAD). Resolution and sharpness of the first toner image is improved if the second toner image is formed by imagewise exposing a photoconductive member through a transparent base. Scavenging of the first toner image by the development of the second toner image and other aspects of the method are improved by use of a rotating magnetic core to drive a developer containing hard magnetic carrier in a soft brush through contact with the electrostatic image.

14 Claims, 5 Drawing Sheets

METHOD FOR FORMING TONER IMAGES WITH TWO DISTINCT TONERS

This invention relates to the formation of toner images and, more specifically, to the formation of toner images of two distinct toners, for example, toners of two different colors.

U.S. Pat. No. 5,001,028 to Mosehauer et al, issued Mar. 19, 1991, is representative of a large number of patents which show the creation of multicolor toner images by creating two unfixed images on a single frame of a photoconductive image member. Color printers have been marketed using this general approach, using discharged area development (DAD) and electronic exposure for each image.

In the Mosehauer patent, the second and subsequent images are toned with a particular toning process using high coercivity carrier and a rotating magnetic core. This process provides a very soft magnetic brush which disturbs the earlier toner images less than an ordinary magnetic brush, even though the brush strands may be allowed to contact the image member.

"Scavenging" of first image toner into the second station is a well documented problem, especially of repetitive DAD toning steps (DAD-DAD imaging). Many prior references suggest projection toning for applying toner to second and subsequent images in DAD-DAD processes. This reduces "scavenging" of the first image into the second toning station, but it also reduces the speed at which the second image can be toned to reasonably full density. U.S. Pat. No. 5,409,791 to Kaukeinen et al, issued Apr. 25, 1995, demonstrates that the use of a toning process similar to that used in the Mosehauer reference but with the brush strands separated from the image member can maintain both the reduced scavenging of projection toning while still toning at high speed (albeit not as high as contact toning as shown in Mosehauer).

Although projection toning reduces scavenging to tolerable limits and the use of the Kaukeinen invention provides improved density at high speed compared to prior projection systems, performance of projection toning is heavily dependent upon accurate spacing between a toning applicator and the image member. Such spacing has been found to be quite difficult to maintain in practice and, in fact, is accomplishable only by putting more complexity and expense into the components themselves.

European Patent Application 94-107101.1, published Nov. 23, 1994 (Publication No. 0 625 730), describes a problem with a DAD-DAD system in which toner on the edges of areas of the first image, which abut second images, have a tendency to move into the second image as a result of the second exposure. Overlapping of the first image with the second image corrects this problem in this process. The image overlapping is facilitated by exposing the second image through the base.

A few references suggest a mixture of discharged area development and charged area development (DAD and CAD). For example, see U.S. Pat. No. 5,045,893 to Tabb, granted Sep. 3, 1991, in which the first toner image is made using DAD, the image member is recharged and re-exposed with the second image made using CAD. See also in this respect, U.S. Pat. Nos. 5,208,636; 5,241,356; 5,049,949; and 5,258,820.

SUMMARY OF THE INVENTION

It is an object of the invention to improve on such prior multi-image systems.

This and other objects are accomplished by a method in which an image member is charged to a first polarity and exposed to create an electrostatic image. The electrostatic image is developed with toner also charged to the first polarity (DAD). The image member is preferably not recharged, but is exposed to create a second electrostatic image, still of the first polarity. This image is toned with a toner of a second polarity opposite the first polarity (CAD). Preferably, the second toning step uses contact development with a magnetic brush of the Mosehauer type. That is, it has "hard" magnetic carrier and a rapidly rotating magnetic core with the developer moving into direct contact with the image member during the development process. Because of the contact development, applicator to image member spacing is no longer critical, and image density at high speed is improved. Scavenging is far less than with a DAD-DAD process because the development field in the second station is maintained at a level that rejects toner of the first polarity. Also, because of the fields, there is very little "overtoning" of the first image by the second station.

In experimenting with this process, we found that line images had a tendency to lose their resolution. After some analysis, we concluded that this was due to movement of toner in response to the second exposure step, somewhat similar to the movement of toner in a DAD-DAD process toward which the prior Guth et al patent application was directed (European Publication No. 0 625 730, cited above). We have demonstrated that this problem is corrected when the second exposure is accomplished from the side of the image member opposite that containing the first toner image. This allows us to discharge the image member under the first image to a level below that of the untoned portions of both images. Note that this is not a case of overlapping toner images, as was done in the Guth application, since the image portion of the second image may be quite separated from the first toner image. It is a solution based on assuring thorough discharge of the area under the first toner image in the second exposure.

Thus, according to a preferred embodiment, high resolution two color toner images are produced with little scavenging using a DAD-CAD process with contact developing of the second image with a brush having "hard" magnetic carrier and a rotating magnetic core and with a second exposure through the side of the image member opposite the first toner image.

DETAILED DESCRIPTION OF THE INVENTION

FIGS. 1–7 illustrate a DAD-CAD method (sometimes herein called a "submethod") of forming a two color toner image. According to FIG. 1, an image member 1 includes an image side 2 and an opposite or base side 4. Preferably, the image member 1 is transparent. For example, it can be a belt or web image member having a polyester or other suitable transparent support well known and used in the art. Such image members include a transparent conductive layer on the image side 2 upon which is coated suitable photoconductive layers to make the image member 1 photoconductive. The conductive layer and photoconductive layers are extremely thin and are not shown in the FIGS. The image member could also be a glass drum with similar layers coated thereon.

The method will be described with respect to a negative charging image member. It will be clear to those skilled in the art that a positive charging image member could also be used.

Figure 1:
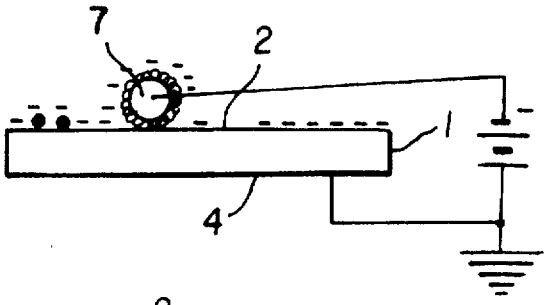
FIGS. 1–7 show seven steps in a method for forming a two color image.
Figure 2:
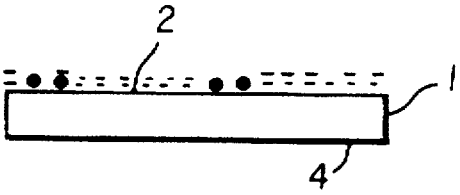

The image member is uniformly charged to a negative potential. It is imagewise exposed to create a negative electrostatic image and, as shown in FIG. 1, a negative toner is applied to it in the presence of an electric field which encourages deposition of the negative toner according to the amount of discharge of the electrostatic image. That is, the toner shown in FIG. 1 adheres to areas of lowest potential in the electrostatic image, creating a first toner image, as shown in FIG. 2, created by a DAD process.

Figure 3:
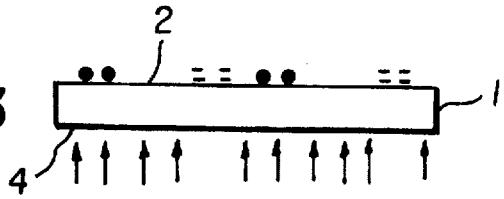

According to FIG. 3, the image member is exposed through its base 4 (preferably without recharging) to create a second electrostatic image. It is important that this exposure be conducted through the base in order to discharge the charge underneath the first toner image below that of exposed areas surrounding the first toner image. If this charge is not dissipated, the negatively charged first toner has a tendency to be pushed by that charge into the areas adjacent it that have been equally or more discharged, thereby reducing the sharpness and resolution of the first toner image. With exposure through the base, we have been able to reduce the charge underneath the first toner image to 50–100 volts below that of areas surrounding the image that are also exposed. This allows the adjacent negative charge to hold the negative toner of the first image in place.

Figure 4:
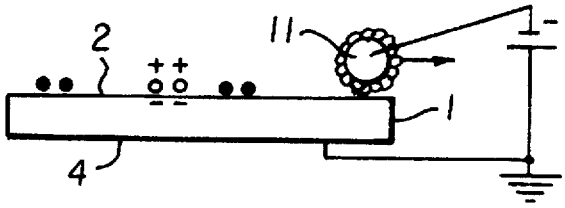

According to FIG. 4, the second electrostatic image is toned using a CAD toning process. More specifically, a magnetic brush 11 containing positive toner applies toner to image member 1 in the presence of an electric field that encourages deposition of toner on the high potential portions of the second electrostatic image. Typically, in CAD development, the electric field is biased so that magnetic brush 11 is slightly more negative than the exposed portion of the second electrostatic image to inhibit development of the nonimage areas in the second electrostatic image. This bias also inhibits pickup of negative toner from the first image.

Figure 6:
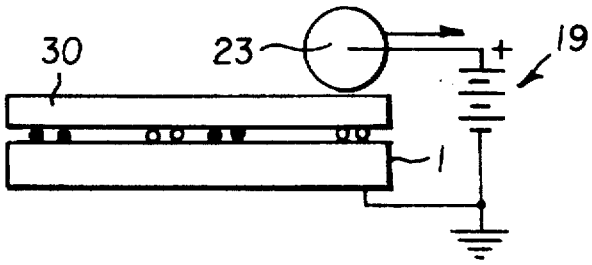
Figure 7:
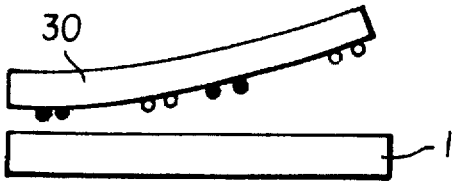

The two color toner image, shown in FIG. 4, contains both negatively charged and positively charged toner. For electrostatic transfer, the image is treated so that it responds more uniformly in an electrical field. According to FIG. 5, this is accomplished by using a negatively biased corona charger 15 which sprays negative charges on the image side of the image member 1. As is well known in the art, the charger 15 can be assisted by an erase lamp 17 which, with a transparent image member 1, can be positioned on the opposite or base side of the image member 1. As shown in FIGS. 6 and 7, the two color image is transferred to a receiving sheet 30 in the presence of an electric field created by a bias supplied from a source of potential 19 to is a transfer backing member or roller 23. The receiving sheet 30 is separated from the image member 1, as shown in FIG. 7, with the two color image attached.

The use of CAD developing with opposite polarity toner for the second image greatly reduces the tendency of first toner to scavenge into the second station or for the second toner to overtone the first toner image. This permits the use of contact developing rather than projection developing with its increased density at high speed and greatly reduced sensitivity to spacing.

The reduced scavenging effect is optimized by the use of a brush similar to that shown in the Mosehauer patent. This brush will be discussed in more detail with respect to FIG. 20. It has a very soft nap which reduces the tendency of the brush to scrape off the first image and also provides extremely high density development at high speed with a relatively small development station.

Early resolution problems we encountered were caused by movement of toner in the first image in response to the second exposure step. This movement is due to residual charge of a negative polarity underneath the first toner which pushes the particles into the background of the second image which has less remaining charge after the second exposure. This problem has been virtually eliminated by exposing the second image through the base, as shown in FIG. 3 and as explained above.

Any toner from the first image that has a tendency to be scavenged into the second toning station is likely to be deposited in the background of subsequent images, assuming it has maintained its original charge. The life of the developer in the second station is dependent upon the extent of this scavenging. The point at which a noticeable amount of the first, negative toner from the first image appears in the background of the second image is the point at which the developer must be changed in the second station. Because of the polarities of the toners in the DAD-CAD process, shown in FIGS. 1–7, and the softness of the development brush, shown in FIG. 20, this effect is quite small, and the life of the developer is relatively long. However, we have found two submethods which can prolong the life of the second developer even further.

Figure 8:
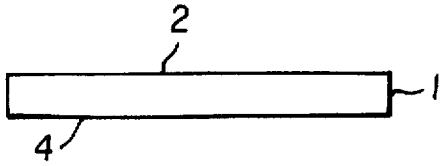
FIGS. 8–14 show a submethod variation on the method shown in FIGS. 1–7.
Figure 9:
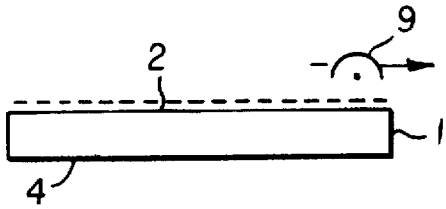
Figure 10:
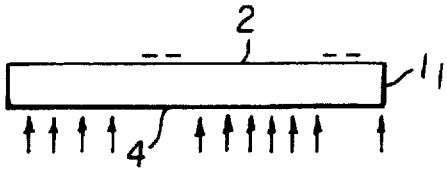

The first submethod is illustrated in FIGS. 8–14. These FIGS. show a method in which there is a demand for second color only images. That is, if the color of the first toner image is black and the color of the second toner image is red in the process shown in FIGS. 1–7, the same apparatus will, from time to time, be asked to make only red images for one or more runs. Image member 1 is shown in FIG. 8 without any charge on it as it enters the process. According to FIG. 9, it is charged to a negative polarity by the same charging device 9 used to form the first electrostatic image in FIG. 1. According to FIG. 10, the image member 1 is imagewise exposed to create a negative electrostatic image, and according to FIG. 11, that electrostatic image is toned by application of positive toner from magnetic brush 11.

Magnetic brush 11 has been operating for many images without changing the developer and contains some negatively charged toner that had been scavenged from first, black images in earlier two-color image forming runs. Some of these negatively charged black toner particles have a tendency to deposit in the background portions of the electrostatic image, as shown in FIG. 11.

Figure 5:
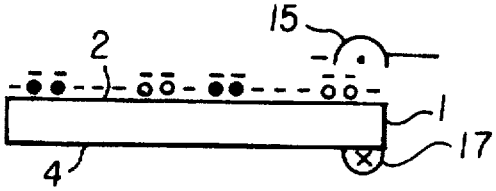
Figure 11:
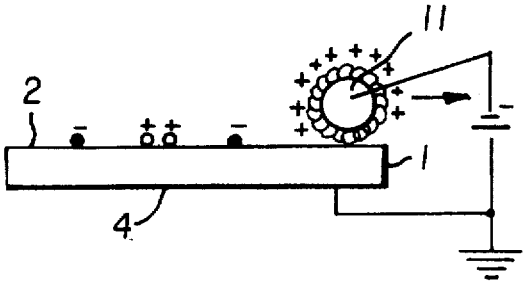
Figure 12:
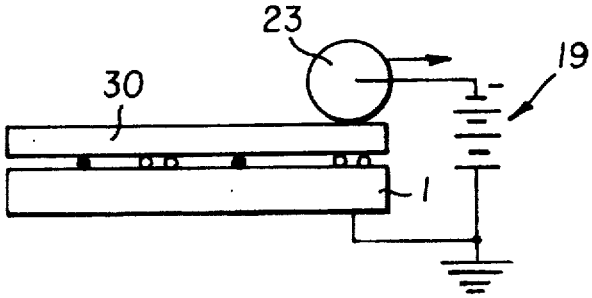
Figure 13:
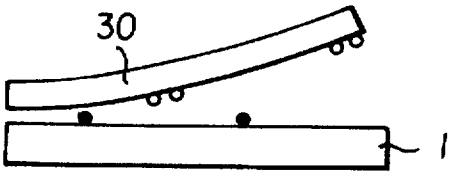
Figure 14:
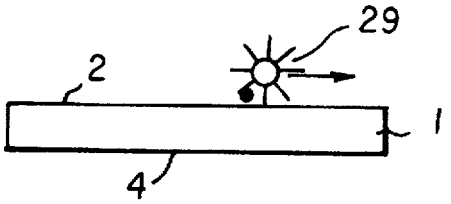
Figure 15:
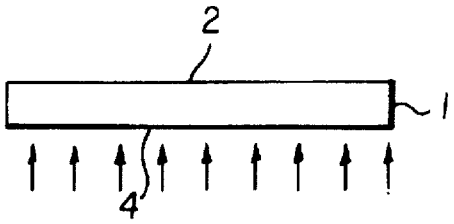
FIGS. 15–18 show a four step submethod which is a variation to the submethod shown in FIGS. 8–14.

However, for the submethod shown in FIGS. 8–14 where only red images are desired, the treatment step shown in FIG. 5 is eliminated and the red image with some black toner particles in its background is fed into the transfer station, as shown in FIG. 12. However, the transfer field is reversed in FIG. 12 from that shown in FIG. 6 to encourage the transfer of untreated positively charged (red) toner particles while inhibiting the transfer of negatively charged (black) toner particles. Thus, as shown in FIG. 13, the receiving sheet 30 is separated from image member 1 with the red toner image adhering to receiving sheet 30 and the black toner adhering to image member 1. As shown in FIG. 14, the black toner is cleaned off image member 1 by a cleaning device 29 at a cleaning station so that the image member 1 can be reused.

The submethod shown in FIGS. 8–14 provides background-free copy with an old developer while actually getting rid of some of the contamination of magnetic brush 11. An extended single color run of this nature would have a cleansing effect on the second development station, thereby prolonging the life of its developer.

Figure 16:
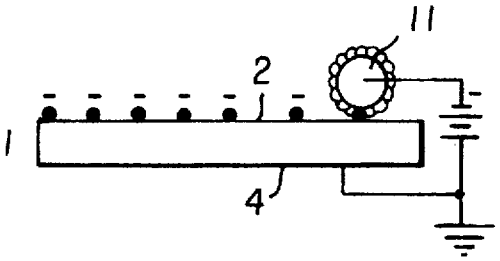
Figure 17:
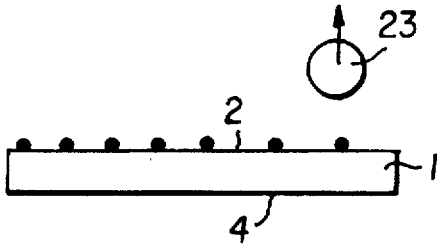
Figure 18:
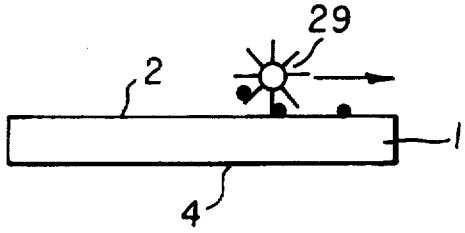

FIGS. 15–18 illustrate use of a similar submethod to that shown in FIGS. 8–14 to clean the second development station without actually making images. According to FIG. 15, the image member is discharged by some means, for example, the same exposure means that forms the electrostatic image in FIGS. 3 and 10. According to FIG. 16, the magnetic brush 11 is allowed to attempt to tone the discharged image member 1 in the presence of a field urging the application of negative toner to image member 1 while discouraging the application of any positive toner. This field is shown in FIG. 16 as having a somewhat stronger negative bias on toning station 11 than is used for development (FIGS. 4 and 11). The treating step shown in FIG. 5 can be again eliminated. The transfer step, shown in FIG. 6, is also eliminated. No receiving sheet need be fed. As shown in FIG. 17, transfer backing member 23 is articulated away from image member 1. Transfer to the backing member 23 can also be prevented by adjusting the bias on transfer backing member 23 as is done in FIG. 12. If electrostatic transfer is accomplished by a corona, the corona need only be turned off. The negative (black) toner on image member 1 is then cleaned off by cleaning device 29, as shown in FIG. 18.

The submethod shown in FIGS. 15–18 can be employed any time the apparatus is otherwise not in use, for example, it can be routinely used while the apparatus is warming up, since the routine does not require use of a fuser which may require the longest warmup time.

Figure 19:
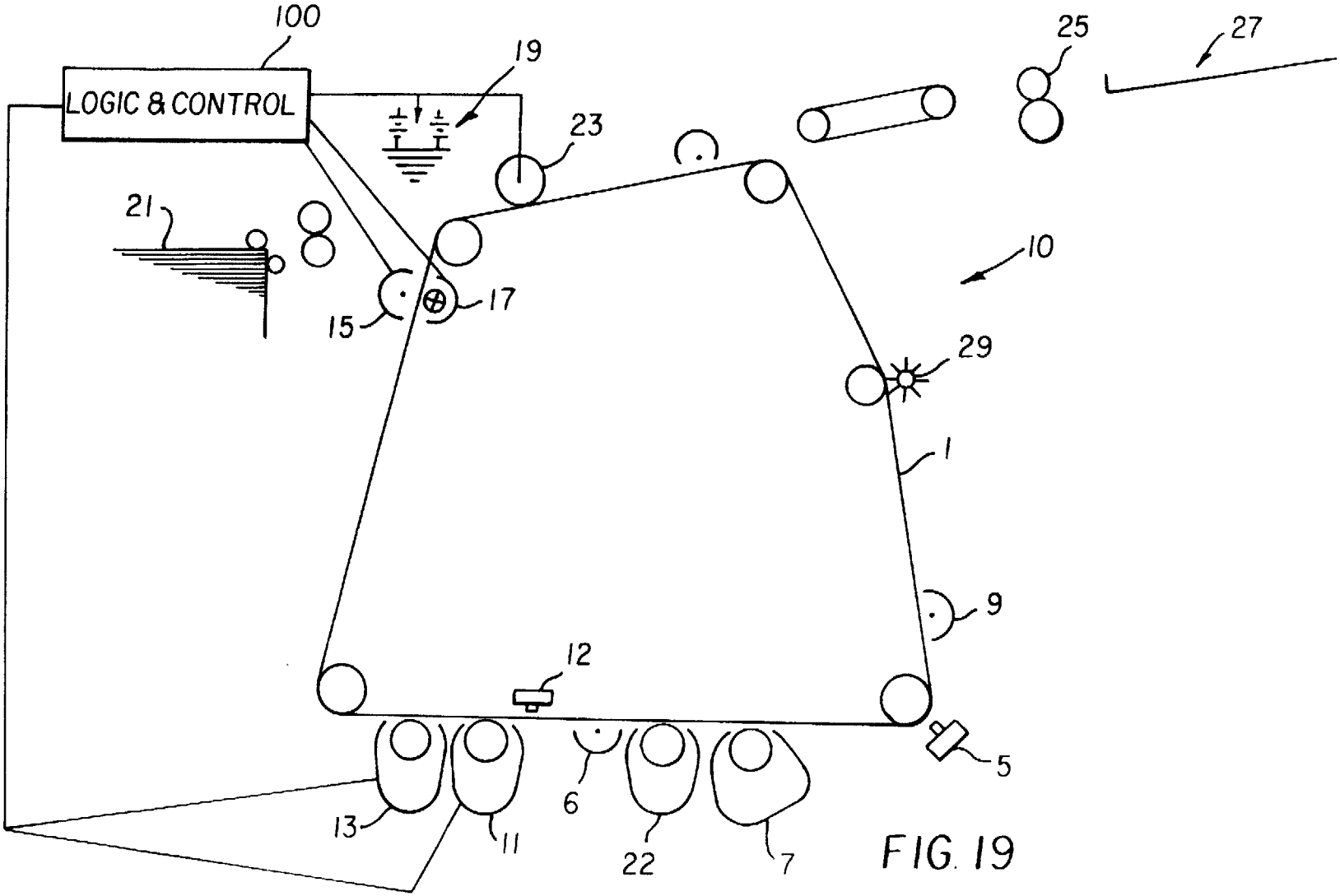
FIG. 19 is a side schematic of an image forming apparatus.

FIG. 19 shows an image forming apparatus 10 for carrying out all three submethods shown in FIGS. 1–18. According to FIG. 19, an image member 1 in the form of a transparent photoconductive belt is trained about a series of rollers for movement through a path past a series of stations. Image member 1 is uniformly charged by a charging station 9 and imagewise exposed at a first exposure station, for example, an LED printhead 5, a laser, or the like, to form a first electrostatic image. The first electrostatic image is of a first polarity as determined by the charge from charging station 9.

A first toner of a first color and a first polarity (for example, negative black toner) is applied to the first electrostatic image by a suitable toning station 7 to form a first toner image. Because the toner is negative in polarity, it adheres most densely to the most discharged portions of the first electrostatic image (DAD development).

The image member with the first toner image can be recharged by a charging station 6, again, to a negative potential (a step that may well not be necessary). Whether recharged or not, it is imagewise exposed by a second exposure station, for example, an LED printhead 12, laser, or the like, positioned behind image member 1 to create a second electrostatic image. This electrostatic image is toned by the application of positively charged toner of a second color (for example, red) from the previously shown second toning station 11. Alternatively, the second electrostatic image can be toned by application of positively charged toner of a third color, for example, yellow, from a third toning station 13.

Preferably, both toning stations 11 and 13 are constructed, as will be described with respect to FIG. 20, to provide a soft magnetic brush having a tendency to cause little disturbance to the first toner image and providing extremely high density at high speed with a relatively small station.

If the colors of the toners in toning stations 7 and 11 (or 13) are of different color, image member 1 now has a two color image. Obviously, the toners in stations 7 and 11 could be of the same color but different characteristics. For example, one of the two toners could be a black magnetic toner and the other a black non-magnetic toner, which arrangement would have certain advantages in certain processes. For purposes herein, such a combination of non-magnetic and magnetic black toners is essentially the same as a two color toner image.

The two color toner image proceeds to a treatment station made up of a corona charger 15 and an erase lamp 17. Corona charger 15 is biased to change the polarity of one of the toners making up the two color toner image. For example, it may apply a negative charge to the two color image, thereby changing the charge on the positive toner particles applied at either toning station 11 or toning station 13. As is well known in the art, this process can be assisted by use of an erase lamp 17 positioned at and/or before the corona charger 15 which further reduces the affinity of the toner for image member 1.

The treated two color image proceeds to the transfer station, including a transfer backing roller 23, where a potential is applied from a reversible potential source 19, encouraging transfer of the toner from a receiving sheet fed from a receiving sheet supply 21.

The receiving sheet is separated from image member 1 as image member 1 passes around a small roller and is transported to a fuser 25 and eventually into an output tray 27. Cleaning station 29 cleans the image member 1 so that it can continue to be used in the process.

The above description describes operation of image forming apparatus 10 in carrying out the submethod described with respect to FIGS. 1–7. In carrying out the submethod described in FIGS. 8–14, exposing LED printhead 5 and toning station 7 are turned off while single color images are made using charging station 9, exposing LED printhead 12 and either of toning stations 11 or 13. Corona device 15 and erase lamp 17 are also turned off, and the bias applied from reversible voltage supply 19 to backing roller 23 is reversed so that the red or yellow toner applied by stations 11 and 13, in fact, transfers to the receiving sheet, while any black toner contained in either of those stations that is deposited in the background continues on on image member 1 to be cleaned off by cleaning device 29.

The submethod described with respect to FIGS. 15–18 is carried out by the image forming apparatus 10, for example, during cycle-up of the apparatus 10 when it is initially turned on for the day. During such cycle-up, while the fuser 25 is warming up, the image member 1 is driven through its endless path. LED printhead 12 and either or both of toning stations 11 and 13 are turned on. LED printhead 12 fully erases any charge on image member 1 and bias is applied to stations 11 and 13 which encourages the deposition of any black toner remaining in those stations onto image member 1. The black toner, being negative in polarity, is repelled by a strong negative bias on toning stations 11 and 13. Again, corona 15 and erase lamp 17 are turned off and transfer backing member 23 is articulated away from image member 1 to allow the black toner on image member 1 to continue to the cleaning device 29. Obviously, no sheet is fed from receiving sheet supply 21 for this portion of the operation. As mentioned above, backing member 23 can be maintained in place but biased to prevent the transfer of toner to it.

Operation of the image forming apparatus 10 is controlled by logic and control 100 which turns on and off all of the subsystems in appropriate timing, as is well known in the art. As shown in FIG. 19, it especially controls the bias applied to transfer backing roller 23 and the actuation of corona 15 and erase lamp 17 for working of the submethods shown in FIGS. 8–18. It also controls the bias on the development stations, including the bias applied to stations 11 and 13 during the subprocess shown in FIGS. 15–18.

Another toning station 22 is shown in FIG. 19. This station could be used to provide a second primary color alternative to that supplied by station 7 for the DAD image. However, it can be used for a different purpose to further prevent scavenging of toner applied by station 7. More specifically, for this purpose, station 22 contains clear toner of the same polarity as the toner in station 7 (negative, in the example). This station 22 is biased to apply a light topping of clear toner to the first toner image created by stations 9, 5 and 7. This toner does not affect the density of the image because it is clear. However, if any toner is scavenged from the image by stations 11 or 13, it is likely to be the toner on top, i.e., the clear toner supplied by station 22. Eventually, some toner from station 7, for example, black toner, will be scavenged by station 22 since they are of both the same polarity.

The use of the clear toning station 22 greatly prolongs the life of the developers in stations 11 and 13. However, the use of the clear toner also has another advantage. Gradual scavenging of black toner into the clear station is quite obvious and can be readily measured by either measuring light reflected or transmitted through toner in station 22. This allows a monitor of the scavenging effect of the system which, properly calibrated, can give the operator an indication when the developers in stations 11, 13 and 22 should be changed.

This feature associated with the use of clear toner in station 22 is shown with respect to a DAD-CAD process. In fact, it is particularly useful in any process in which an electrostatic image is toned in the presence of an unfixed toner image of any polarity. Note that, because the station 22 involves DAD development, scavenging into it is more likely than it is into stations 11 and 13, both of which are shown to be CAD stations in FIG. 19. Thus, projection toning is preferred in station 22.

Figure 20:
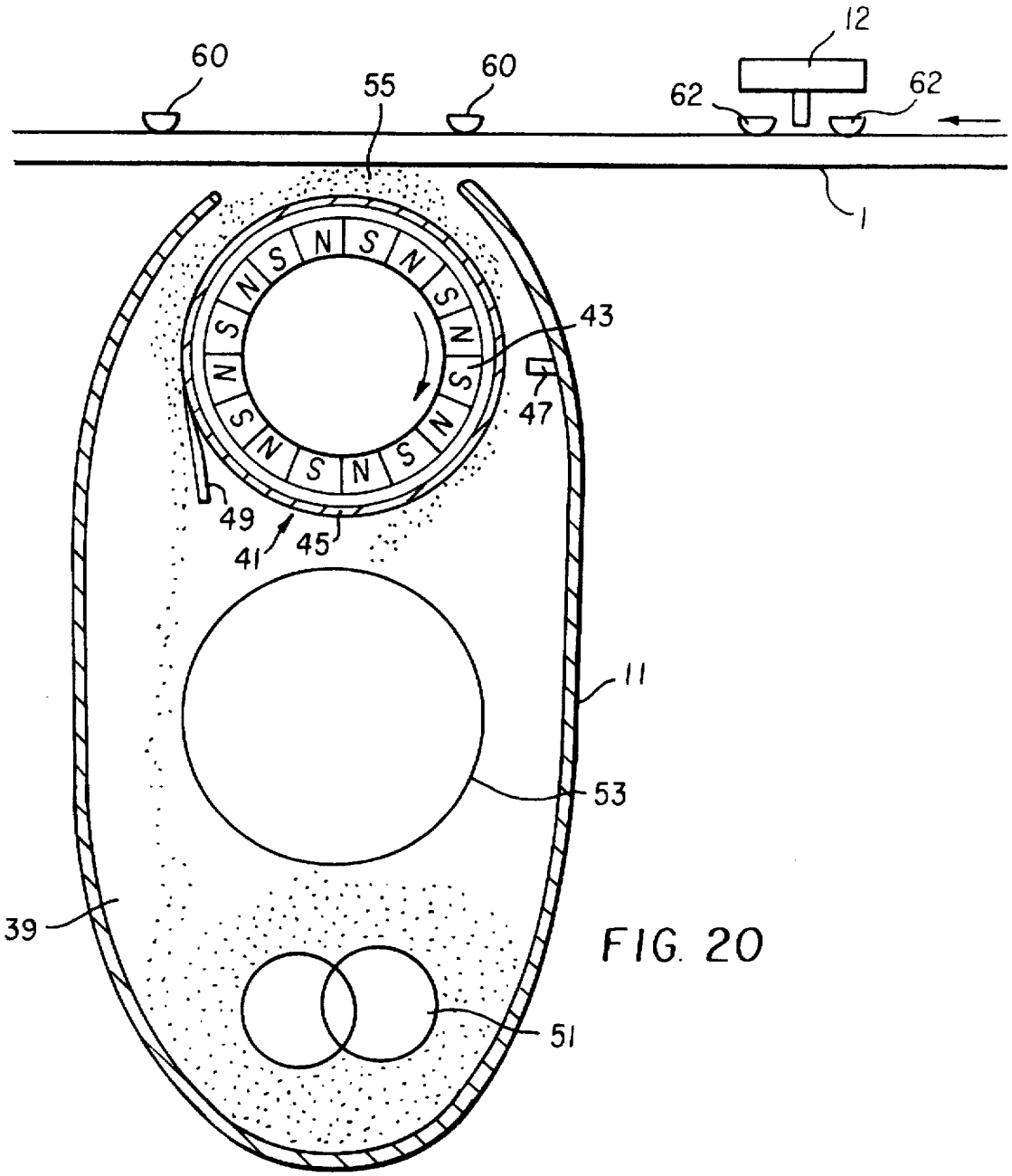
FIG. 20 is a side schematic of a development station.

FIG. 20 shows in detail a preferred embodiment of toning station 11 (and also station 13). Toning station 11, as shown in FIG. 20, embodies technology first disclosed in U.S. Pat. No. 4,546,060, Miskinis et al, issued Oct. 8, 1985, and further described in U.S. Pat. No. 5,001,028 to Mosehauer et al (cited above), both of which patents are hereby incorporated by reference herein. Toning station 11 includes a housing which defines a sump 39 in which a supply of developer is mixed by suitable mixing augers 51. The developer includes "hard" magnetic carrier having a coercivity of at least 300 gauss, preferably in excess of 800 gauss, when magnetically saturated. The carrier exhibits an induced magnetic moment of at least 20 EMU per gram of carrier when in an applied field of 1,000 gauss. The toner is a typical insulative toner and is mixed thoroughly with the carrier (the combination generally being termed a "developer").

The developer is transported from sump 39 by a suitable transport device 53 to an applicator 41 for application to an electrostatic image carried by image member 1. Transport device 53 can include a valving feature, well known in the art, which can turn off the station by cutting off the supply of developer to applicator 41. Applicator 41 includes a rotatable magnetic core 43 positioned inside an also rotatable non-magnetic sleeve or shell 45. Although the core and shell can be rotated in either direction, most commercial embodiments rotate the core 43 at speeds of 1,000 revolutions per minute or higher in a clockwise direction to move the developer in a counter-clockwise direction around shell 45. If shell 45 is moved in a counter-clockwise direction, it also assists in the flow of developer. Alternatively, the developer can be driven in its counter-clockwise direction primarily by rotation of sleeve 45, and core 43 can also be rotated in a counter-clockwise direction. In this last case, the rotation of the core has primarily a mixing function as it actually encourages movement of the developer against the counter-clockwise direction that the developer is driven by the shell 45.

The rapidly rotating core causes rapid pole transitions on the surface of shell 45 which cause the high coercivity carrier to flip rapidly, usually in strings of carrier, as the developer moves through a development zone 55 between applicator 41 and image member 1. The flipping action moves the carrier from the shell to the image member and back rapidly, replacing lost charge and toner. This device and process have been in use for some years and provide highest quality development with a very soft magnetic brush. The softness of this brush was pointed out in the Mosehauer patent as useful in developing an electrostatic image on an image already carrying an unfixed toner image of a different color. The height of the developer nap is controlled, in part, by a skive 47, and the developer itself is skived off the sleeve 45 by another skive 49 so it can fall back into the sump 39 where it is mixed. The developer station itself is mounted opposite a pair of skis 60 which control the position of image member 1 with respect to applicator 41. Similarly, printhead 12 also includes one or two skis 62 which control the location of image member 1 with respect to it.

Although the core 43 and shell 45 are shown to have the same axis of rotation, some high quality commercial embodiments offset the core and shell axes. This strengthens the magnetic field in the development zone 55 and weakens it opposite the development zone where developer is returned to the sump 39. This construction works especially well when the developer is being moved entirely by shell movement and the core is only mixing, since the skive 49 is relatively ineffective in such an embodiment.

The development station 11, as shown in FIG. 20, provides the highest quality of development available and accomplishes this with very high density at a very high toning speed. Because of the pole transitions and flipping of the strings of carrier themselves, this density and speed can be accomplished with a station of extremely modest size. When the softness of this brush is combined with the scavenging suppressing field associated with CAD developing, remarkably little scavenging occurs.

The invention has been described in detail with particular reference to a preferred embodiment thereof, but it will be understood that variations and modifications can be effected within the spirit and scope of the invention as described hereinabove and as defined in the appended claims.

We claim:

1. An image forming method comprising:

forming a first electrostatic image of a first polarity on a first side of a photoconductive image member;

applying a first toner of the first polarity to the first electrostatic image to form a first toner image on said first side;

imagewise exposing the image member from a second side of the image member opposite the first side to form a second electrostatic image in registration with the first toner image; and applying a second toner of a second polarity opposite the first polarity to the second electrostatic image to form a second toner image in registration with the first toner image.

2. An image forming method according to claim 1 wherein the step of applying a second toner to the second electrostatic image includes moving a developer containing a mixture of hard magnetic carrier particles and toner particles through a development zone in contact with the second electrostatic image.

3. An image forming method according to claim 2 wherein the step of applying a second toner includes subjecting the developer to rapid magnetic pole transitions while it is moving through the development zone.

4. An image forming method according to claim 3 wherein the developer is moved through the development zone at least in part by the rotation of a magnetic core inside a non-magnetic sleeve upon which the developer moves and said pole transitions are provided by the rotating magnetic core.

5. An image forming method according to claim 1 wherein the imagewise exposing step reduces the level of charge on the image member underneath the first toner image to a level less than the level of charge in exposed areas outside the first toner image.

6. An image forming method according to claim 5 wherein the step of applying a second toner includes applying the toner in the presence of an electric field of a direction discouraging removal of toner in the first toner image and discouraging the deposit of the second toner in the discharged portions of the second electrostatic image including the first toner image.

7. An image forming method comprising:

applying a uniform charge of a first polarity to a first side of a photoconductive image member;

imagewise exposing the image member to form a first electrostatic image of the first polarity on the image member;

applying a first toner of the first polarity to the first electrostatic image to form a first toner image on the first side of the image member;

imagewise exposing the image member to form a second electrostatic image in registration with the first toner image; and applying a second toner of a second polarity opposite the first polarity to the second electrostatic image to form a second toner image in registration with the first toner image, said step of applying a second toner including moving a developer of hard magnetic carrier particles and toner particles through contact with the image member while subjecting the developer to rapid magnetic pole transitions which flips the developer to and away from the second electrostatic image.

8. An image forming method according to claim 7 wherein the step of imagewise exposing to form a second electrostatic image includes imagewise exposing the image member from the side of the image member opposite the side carrying the first toner image.

9. An image forming method according to claim 7 wherein the step of applying a second toner includes positioning an applicator including a rotatable magnetic core inside a non-magnetic rotatable shell in close proximity to the first side of the image member and rotating the core and sleeve sufficiently to move the developer along the sleeve and into contact with the image member, said magnetic core being rotated rapidly enough to subject the developer in contact with the image member to said rapid pole transitions.

10. An image forming method according to claim 9 further including rotating the non-magnetic shell in the direction of movement of the developer to assist in movement of developer into contact with the image member.

11. An image forming method according to claim 10 further including rotating the magnetic core in a direction the same as the rotation of the shell to provide pole transitions which have a tendency to mix the developer as it is moved by the shell into contact with the image member.

12. An image forming method according to claim 7 wherein the step of applying a second toner includes electrically biasing the developer to a level discouraging pickup by the developer of toner in the first toner image.

13. An image forming method according to claim 12 wherein the substep of electrically biasing includes biasing the developer to a level discouraging the deposit of the second toner in exposed portions of the second electrostatic image including portions covered by the first toner image.

14. The method according to claim 5 wherein the first and second toners are of different color and the method forms a two color image.

* * * * *

UNITED STATES PATENT AND TRADEMARK OFFICE

CERTIFICATE OF CORRECTION

PATENT NO. : 5,748,218

DATED : May 5, 1998

INVENTOR(S) : Eric C. Stelter, et. al.

It is certified that error appears in the above-identified patent and that said Letters Patent is hereby corrected as shown below:

Add claims 15 and 16 as follows:

15. An image forming method according to Claim 1 and further including: applying a clear toner to said first electrostatic image after applying the first toner to the first electrostatic image but prior to applying the second toner to the second electrostatic image to form a light coating of clear toner on top of the first toner image, thereby inhibiting scavenging of the first toner image during application of the second toner.

16. An image forming method according to Claim 7 and further including: applying a clear toner to said first electrostatic image after applying the first toner to the first electrostatic image but prior to applying the second toner to the second electrostatic image to form a light coating of clear toner on top of the first toner image, thereby inhibiting scavenging of the first toner image during application of the second toner.

Signed and Sealed this

Sixth Day of April, 1999

*Attest:*

Q. TODD DICKINSON

*Attesting Officer*

*Acting Commissioner of Patents and Trademarks*